United States Patent [19]

Chapman et al.

[11] 4,121,280

[45] Oct. 17, 1978

[54] ARTICULATED LIGHT FIXTURE

[76] Inventors: Earle F. Chapman, Summer St., Marshfield, Mass. 02051; Bernard J. Ruskin, 17 Sheldon Rd., Marblehead, Mass. 01945

[21] Appl. No.: 736,557

[22] Filed: Oct. 28, 1976

[51] Int. Cl.[2] ..... F21S 1/02

[52] U.S. Cl. ..... 362/418; 285/282; 248/282

[58] Field of Search ..... 240/73 BJ, 73 BA, 73 R, 240/81 BE, 81 BA, 81 R; 285/282; 248/282; 403/163-165, 181

[56] References Cited

U.S. PATENT DOCUMENTS

| | | | |
|---|---|---|---|
| 2,048,313 | 7/1936 | Adolfson | 248/282 X |
| 2,164,390 | 7/1939 | Dickerson | 248/282 |
| 2,220,216 | 11/1940 | Cloutier | 248/282 |
| 2,242,303 | 5/1941 | Irmischer | 248/282 X |
| 2,488,898 | 11/1949 | Brasty | 248/282 |
| 2,665,330 | 1/1954 | Wong | 240/73 R X |
| 3,601,598 | 8/1971 | Horn | 240/73 BJ |
| 3,983,386 | 9/1976 | Schallenkammer | 240/81 R |

*Primary Examiner*—Richard L. Moses
*Attorney, Agent, or Firm*—Morse, Altman, Oates & Bello

[57] ABSTRACT

A wall mountable light fixture with a dimmer for controlling luminescence and having a plurality of articulated arms that are movable between a retracted position adjacent the wall and an extended position outwardly of the wall. The arms are interconnected by swivel joints, each of which includes a pair of rotatable cooperating members that are juxtaposed in mating relationship. The mating face of each rotatable member is formed with an arcuately disposed race of predetermined length. A ball received within a channel formed by the races of juxtaposed rotatable members constrains the swivel joint to a maximum rotation of one revolution.

10 Claims, 7 Drawing Figures

ARTICULATED LIGHT FIXTURE

BACKGROUND OF THE INVENTION

1. Field of Invention

The present invention relates to light fixtures and, more particularly, is directed wall mounted swivel lamps.

2. Description of the Prior Art

The intensity and orientation of a light source is of key importance in minimizing eye strain, especially when a person is reading or studying for extended periods of time. Wall lamps that have been designed with extensible bodies have suffered from the disadvantage that continued flexing of the internal wire has caused premature failure.

SUMMARY OF THE INVENTION

It is an object of the present invention to provide an improved light fixture in the form of an extensible, variable intensity wall lamp.

Another object of the present invention is to provide an extensible wall mounted light fixture with a dimmer for controlling luminescence and having articulated arms that are movable between retracted and extended positions on swivel joints constrained for rotational movement of one complete revolution. Each swivel joint includes a pair of rotatable mating members that are juxtaposed in axial alignment. Each rotatable member is formed with a central bore through which a power cord is threaded. An arcuate race that is coaxial with the central bore is formed in the mating face of each rotatable member, juxtaposed races forming a channel configured to receive a ball. The approximate mean length of each race is defined by the sum of the race radius multiplied by pi and the diameter of the ball. The channel and ball cooperate to confine rotation of the cooperating members to one complete revolution.

Other objects of the present invention will in part be obvious and will in part appear hereinafter.

The invention accordingly comprises the apparatuses, together with their parts, elements and interrelationships that are exemplified in the following disclosure, the scope of which will be indicated in the appended claims.

BRIEF DESCRIPTION OF THE DRAWINGS

A fuller understanding of the nature and objects of the present invention will become apparent upon consideration of the following detailed description taken in connection with the accompanying drawings, wherein.

DETAILED DESCRIPTION OF THE PREFERRED EMBODIMENTS

Figure 1:
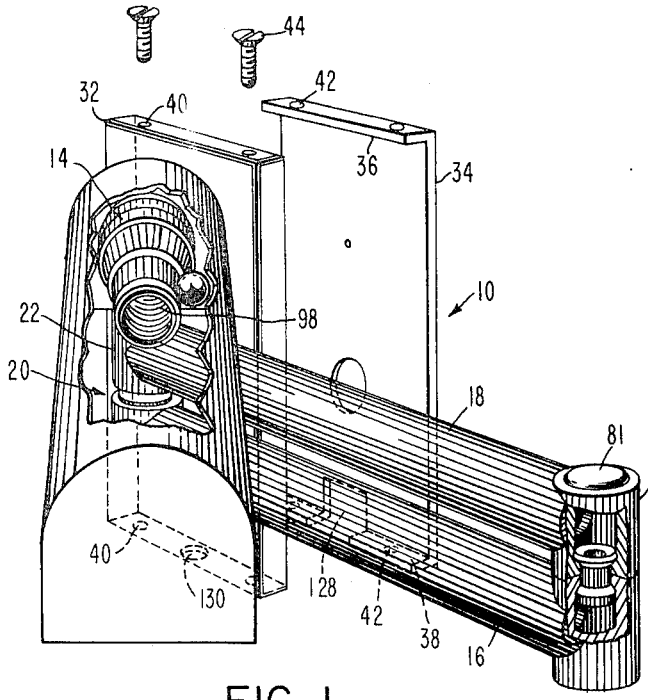
FIG. 1 is a perspective view, partially cutaway, of a light fixture embodying the invention.
Figure 3:
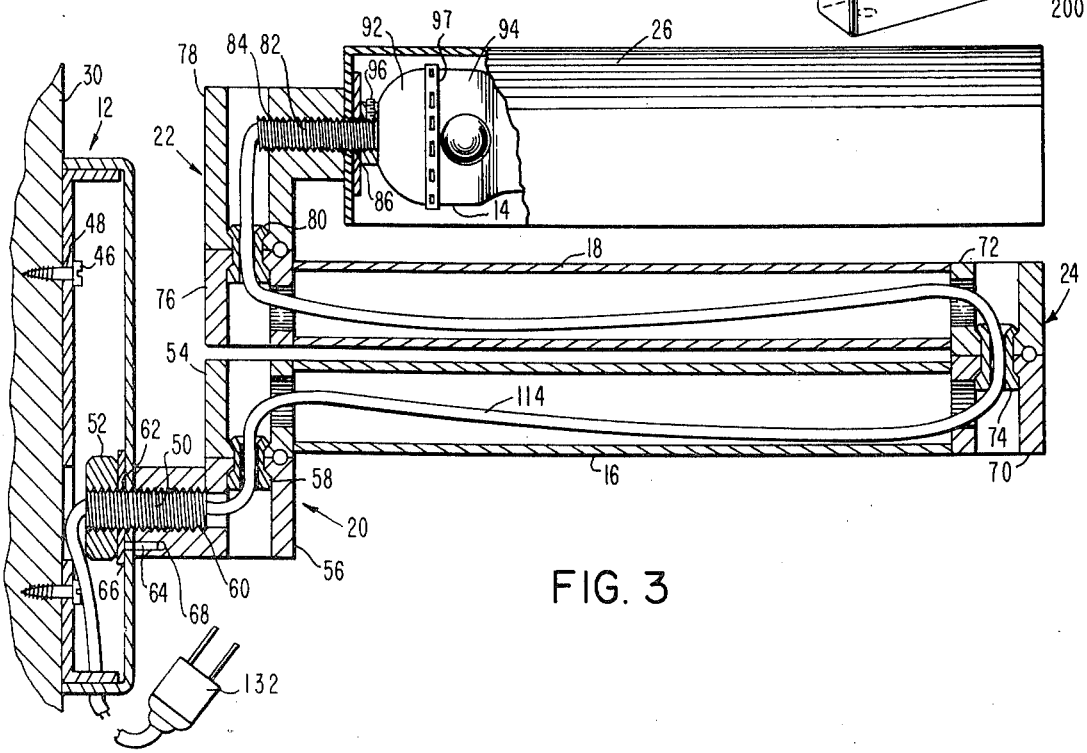
FIG. 3 is a sectional view of the light fixture of FIG. 1.
Figure 7:
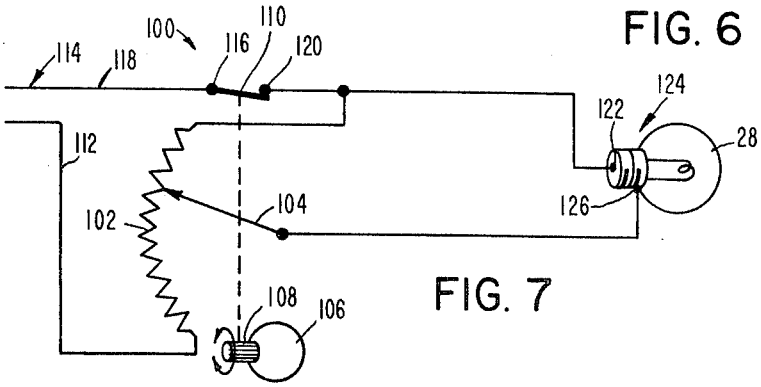
FIG. 7 is a schematic diagram of the variable intensity controller incorporated into the light fixtures of FIGS. 1 and 2.

Referring now to the drawings, in particular FIGS. 1 and 3, there is shown an extensible light fixture 10 comprising a base 12 and a socket 14 that are interconnected by a pair of articulated arms 16, 18 and swivel joints 20, 22 and 24. A shade 26 partially covers socket 14 which is configured to receive a lamp 28, for example an incandescent lamp (FIG. 7.) Shade 26 is an elongated channel member having a generally U-shaped profile in right cross section with closed ends. Base 12 and one end of arm 16, a lower arm, are joined by swivel joint 20. Lower arm 16 is constrained for a maximum rotation of one complete revolution with respect to base 12 about an axis of revolution of swivel joint 20. One end of arm 18, an upper arm, is connected to socket 14 by swivel joint 22. Socket 14 is constrained for a maximum rotation of one complete revolution about an axis of revolution of swivel joint 22 with respect to upper arm 18. The free ends of lower arm 16 and upper arm 18 are interconnected by swivel joint 24, the arms being constrained for a maximum relative rotation of one complete revolution about the rotational axis of swivel joint 24. Socket 14 is movable between an extended position and a retracted position relative to a wall 30 to which base 12 is mounted. In the retracted position, socket 14 and arms 16, 18 are disposed adjacent wall 30 in a plane that is substantially parallel to a plane in which base 12 lies, the axes of rotation of swivel joints 20 and 22 being in axial alignment. In the extended position, socket 14 and arms 16, 18 are moved outwardly of wall 30.

Base 12 includes a substantially rectangular skirt 32 which is configured to receive a substantially rectangular mounting plate 34, the shorter sides of which are turned inwardly to form flanges 36, 38. Skirt 32 is provided with through holes 40 that are in registration with threaded holes 42 in flanges 36, 38. Screws 44 are received in holes 40 and turned into threaded holes 42 for holding mounting plate 34 to skirt 32. Plate 34 is mounted to wall 30 by means of screws 46 that are passed through holes 48 in plate 34 and screwed into wall 30.

Swivel joint 20 is connected to skirt 32 by an externally threaded tubular rod 50 and a nut 52. Swivel joint 20 includes a pair of cooperating members 54, 56 that are constrained for relative rotational movement with respect to one another of a maximum of one complete revolution. Members 54 and 56 are rotatably held together by a hollow riveted pin 58, a longitudinal axis of pin 58 defining the rotational axis of swivel joint 20. Member 56 is formed with an internally threaded hole 60 into which rod 50 is turned. Rod 50 extends inwardly of skirt 32 through an opening 62 and nut 52 is turned thereon for fastening member 56 to skirt 32. Rod 50 is disposed perpendicularly with respect to the axis of rotation of swivel joint 20. A pin 64 is received within a hole 66 formed in skirt 32 and a bore 68 formed in member 56 for registering hole 60 and opening 62 and for preventing rotation of member 56 with respect to skirt 32. Member 56 is fastened to one end of lower arm 16.

The other end of lower arm 16 and one end of upper arm 18 are joined by swivel joint 24 which includes a pair of cooperating members 70 and 72 that are constrained for a maximum rotational movement of one complete revolution with respect to one another. A hollow riveted pin 74 is provided for fastening member 70 and 72. A longitudinal axis of pin 74 defines the rotational axis of swivel joint 24, members 70 and 72 being constrained for relative rotational movement. The other end of upper arm 18 is connected to swivel joint 22.

Swivel joint 22 includes a pair of cooperating members 76, 78 that are constrained for relative rotational movement with respect to one another of maximum of one complete revolution. Members 76 and 78 are held together for relative rotational movement by a hollow riveted pin 80, a longitudinal axis of which is the rotational axis of swivel joint 22. As best shown in FIG. 1, the opened ends of each swivel joint is closed by a cap 81. Socket 14 is mounted to member 78 by a hollow, externally threaded rod 82 which is turned into an internally threaded bore 84 formed in member 78. Rod 82 is perpendicular to the axis of revolution of swivel joint 22 and extends through an opening 86 formed in shade 26. Socket 14 is mounted to the extending portion of rod 82, a washer 88 placed between socket 14 and opening 86. Socket 14 includes a forward section 90 and a rearward section 92. Rearward section 92 is formed with an annular flange 94 which is adapted to receive rod 82. A fastener 96, for example a set screw, is turned into a threaded hole in flange 94 and engages rod 82, whereby rod 82 is secured within flange 94. The forward end of rearward section 92 is provided with a dimpled annular flange 97 into which the rearward end of forward section 90 is press fitted. The forward end of forward section 90 constitutes a receptacle 98 into which lamp 28 is turned. Mounted within forward section 90 is a variable intensity control 100.

Referring now to the schematic diagram illustrated in FIG. 7, it will be seen that variable intensity control 100 includes a variable impedance 102, for example, a potentiometer having a wiper arm 104 which is operatively connected to a control knob 106 via an insulating rod 108. Knob 106 is connected also to the contact arm of a switch 110. One side of potentiometer 102 is connected to a lead 112 of a power cord 114 and a terminal 116 of switch 110 is connected to a lead 118 of power cord 114. A terminal 120 of switch 110 is connected to a terminal 122 of a lamp socket 124 and the other side of potentiometer 102. Wiper arm 104 is connected to a terminal 126 of socket 124. Power cord 114 is threaded through arms 16, 18 and swivel joints 20, 22 and 24 and exists from lamp 10 through a slot 128 in plate 34 and an opening 130 in skirt 32. In conventional manner, a line plug 132 is attached to the free end of power cord 114. Socket 14 is adapted to receive lamp socket 124 which is adapted to receive incandescent lamp 28. Forward section 90 is formed with an aperture through which insulating rod 108 projects. The intensity of the luminance emitted from lamp 28 is governed by the position of wiper arm 104 which is controlled by the rotation of knob 106. By way of example, when knob 106 is rotated to its most counterclockwise position the intensity of the luminance emitted from lamp 28 is greatest, and when knob 106 is rotated to its most clockwise position the contact between terminals 116 and 120 is broken and lamp 28 is off.

It is preferred that arms 16 and 18, swivel joints 20, 22 and 24, shade 26 and skirt 32 are composed of a metal such as brass, for example, and insulating rod 108 is composed of a linear polyamide resin.

Figure 5:
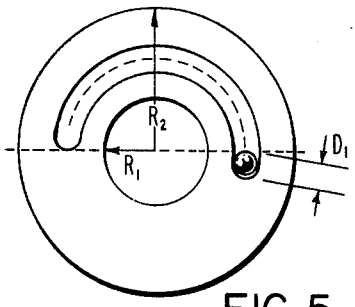
FIG. 5 is a perspective view, partially in section, of one of the swivel joints incorporated in the light fixtures of FIGS. 1 and 2.
Figure 6:
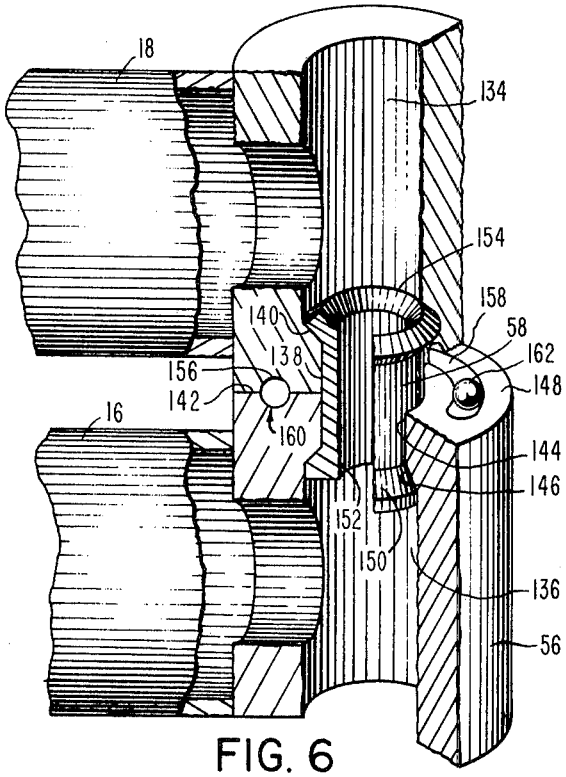
FIG. 6 is a schematic diagram illustrating certain principles of the invention.

As previously indicated, each of swivel joints 20, 22 and 24 is configured to provide a maximum rotation of one complete rotation. The mechanisms of each swivel joint that permits such rotation are identical, the details of one such mechanism, for example that of swivel joint 24 is shown in FIG. 6. Members 54 and 56 are cylindrical members that are formed with longitudinally extending bores 134 and 136 that extend the length of their respective member. As viewed in FIG. 6, bore 134 is narrowed at 138 which is adjacent the lower end of member 54. A shoulder 140 is formed between the enlarged and narrow portions of bore 134, narrowed portion 138 intersecting a mating face 142 of members 54. Bore 136 is narrowed at 144 which is adjacent the upper end of member 56, a shoulder 146 being formed between the narrow and enlarged portions of bore 136. Narrow portion 144 of bore 136 intersects a mating face 148 of member 56. Pin 58 includes an enlarged head 150 and a narrow body 152. Head 150 is received within the enlarged portion of bore 136 and body 152 extends into narrowed portions 144 and 138. Head 150 is larger than the narrow portions of bores 134, 136 and nests on shoulder 146. The end of body 152 is flared at 154 against shoulder 140 so that members 54 and 56 are joined together in such a manner that are freely rotatable and fixed against vertical separation. Mating face 142 of member 54 is formed with a race 156 and mating face 148 of member 56 is formed with a race 158, the races disposed in congruent arcuate paths that are coaxial with the rotational axis of swivel joint 24. Portions of race 156 are aligned with portions of race 158, a channel 160 being formed between aligned portions of the races. A member 162 having a profile corresponding to the profile of channel 160 is received within channel 160. In the illustrated embodiment, race 156 and race 158 have semi-circular profiles in right cross section. Channel 160 has a circular profile in right cross section and member 162 is a ball. The ends of each race 156 and 158 are rounded to conform to the perimeter of ball 162. As diagrammatically shown in FIG. 5, the length of each race 156, 158 is approximately equal to the sum of (1) pi multiplied by the mean radius of channel 160 and (2) the arcuate length of member 162, i.e. the diameter of ball 162. In the preferred embodiment, each race 156 and 158 is disposed midway between the perimeters of the narrowed portions of bores 134, 136 and members 54, 56, each race having an identical length. In this case, the length of each race is:

$$L = \pi (R_1 + R_2 - R_1/2) + D$$

where $R_1$ is the radius of the narrowed portions of the bores;
$R_2$ is the radius of the cooperating members; and
D is the diameter of ball 162.

The arrangement of races 156, 158 to form channel 160 and ball 162 is such that members 54 and 56 are constrained for a maximum relative rotational movement of one complete revolution. For example, at an initial starting point races 154 and 156 are positioned so that the length of channel 160 is the diameter of ball 162, ball 162 being pressed between one end of each race. Arms 16, 18 are connected to swivel joint 24 in such a summer that they are registered and lie in a common vertical plane when swivel joint 24 is at its initial starting point. Member 54 is rotated 180° until races 156 and 158 are aligned. As member 54 is further rotated beyond 180°, an opposite end of race 156 carries ball 162 towards the opposite end of race 158. When member 54 is rotated 360° with respect to member 56, ball 162 is pressed between the opposite ends of the races.

Figure 2:
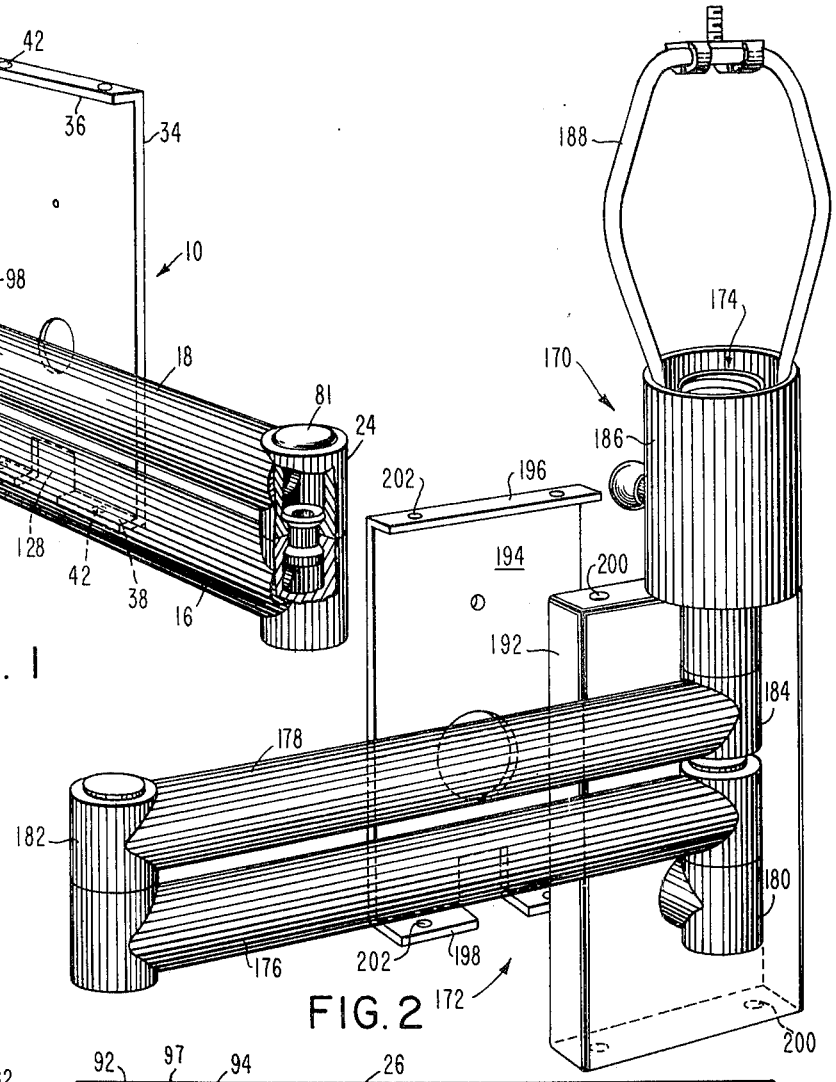
FIG. 2 is a perspective view of an alternative embodiment of the invention.
Figure 4:
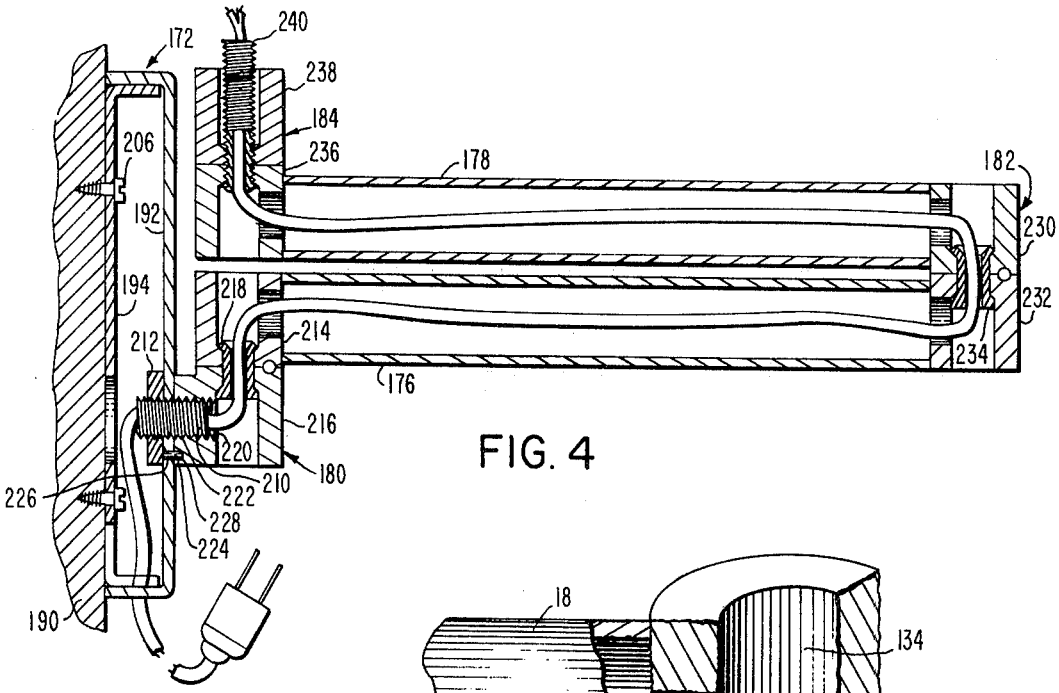
FIG. 4 is a sectional view of the light fixture of FIG. 2 with the socket removed.

An extensible light fixture 170, an alternative embodiment of the invention, is shown in FIGS. 2 and 4. Light fixture 170 comprises a base 172 and a socket 174 that are interconnected by a pair of articulated arms 176, 178, swivel joints 180, 182 and a fixed joint 184. Socket 174 is positioned within a cup 186 having a harp 188 attached thereto. Base 172 and one end of arm 176, a lower arm, are joined by swivel joint 80. Lower arm 176 is constrained for a maximum rotation of one complete revolution with respect to base 172 about an axis of revolution of swivel joint 180. One end of arm 178, an upper arm, is connected to socket 174 by fixed joint 184. The free ends of lower arm 16 and upper arm 18 are interconnected by swivel joint 182, the arms being constrained for a maximum relative rotation of one complete revolution about the rotational axis of swivel joint 182. Socket 174 is movable between an extended position and a retracted position with respect to a wall 190 to which base 172 is mounted. In the retracted position, socket 174 and arms 176, 178 are disposed adjacent wall 190 in a plane that is substantially parallel to a plane in which base 172 lies, the axis of rotation of swivel joint 180 and a longitudinal axis of fixed joint 184 being in axial alignment. In the extended position, socket 174 and arms 176, 178 are moved outwardly of wall 190.

Base 172 includes a substantially rectangular skirt 192 which is configured to receive a substantially rectangular mounting plate 194, the shorter sides of which are turned inwardly to form flanges 196, 198. Skirt 192 is provided with through holes 200 that are in registration with threaded holes 202 in flanges 196, 198. Screws 204 are received in holes 200 and turned into threaded holes 202 for holding mounting plate 194 to skirt 192. Plate 194 is mounted to wall 190 by means of screws 206 that are passed through holes in plate 194 and screwed into wall 30.

Swivel joint 180 is connected to skirt 192 by an externally threaded tubular rod 210 and a nut 212. Swivel joint 180 includes a pair of cooperating members 214, 216 that are constrained for relative rotational movement with respect to one another of a maximum of one complete revolution. Members 214 and 216 are rotatably held together by a hollow riveted pin 218, a longitudinal axis of pin 218 defining the rotational axis of swivel joint 180. Member 216 is formed with an internally threaded hole 220 into which rod 210 is turned. Rod 210 extends inwardly of skirt 192 through an opening 222 and nut 212 in turned thereon for fastening member 216 to skirt 192. Rod 210 is disposed perpendicularly with respect to the axis of rotation of swivel joint 180. A pin 224 is received within a hole 226 formed in shirt 192 and a bore 228 formed in member 216 for registering hole 220 and opening 222 and for preventing rotation of member 216 with respect to skirt 192. Swivel joint 182 is identical in structure and function to swivel joint 20 with the exception that member 56 is longer than member 216. Member 214 is fastened to one end of lower arm 176.

The other end of lower arm 176 and one end of upper arm 178 are joined by swivel joint 182 which includes a pair of cooperating members 230 and 232 that are constrained for a maximum rotational movement of one complete revolution with respect to one another. A hollow riveted pin 234 is provided for fastening member 230 and 232. A longitudinal axis of pin 234 defines the rotational axis of swivel joint 182, members 230 and 232 being constrained for relative rotational movement. Swivel joint 182 is identical in structure and function to swivel joint 24. The other end of upper arm 178 is connected to fixed joint 184.

Fixed joint 184 includes a pair of members 236 and 238 that are held together in fixed relationship by a threaded tubular rod 240 which is disposed vertically. Socket 174 is identical in structure and function to socket 14 and is connected to rod 240 in the manner herein described in connection with socket 14 and rod 82. It is to be understood that socket 174 includes a variable controller of the type mounted within socket 14.

Since certain changes may be made in the foregoing disclosure without departing from the scope of the invention herein involved, it is intended that all matter contained in the above description and depicted in the accompanying drawings be construed in an illustrative and not in a limiting sense.

What is claimed is:

1. An extensible light fixture comprising:

(a) a base configured to be mounted on a wall;

(b) first and second arm means, one end of said first arm means connected to said base;

(c) socket means operatively connected to one end of said second arm means, said socket means configured to receive a lamp; and (d) a first rotatable swivel joint having a pair of cooperating rotatable members that are juxtaposed in mating relationship and are constrained for maximum relative rotation of 360°, one of said members operatively connected to the other end of said first arm means and the other of said members connected to the other end of said second arm means, each said member having an internal shoulder, a first pin engaging each said interval shoulder of each said member, said members constrained for free rotational movement and fixed against vertical separation relative to one another by said first pin, one face of said one member adjacent one face of said other member, said one face of said one member formed with a first race and said one face of said other member formed with a second race, said first and second races of substantially equal length and disposed in congruent arcuate paths that are coaxial with a rotational axis of said first swivel joint, portions of said first race aligned with portions of said second race, a first channel formed between said aligned portions of said races, a first slidable member received in said first channel, said first and second races having an approximate length of the sum of pi multiplied by a radius of said first race and the arcuate length of said first slidable member, the relative rotation of said one member and said other member limited to a maximum of one complete revolution, said slidable member moved a maximum distance of 180° as said members are relatively rotated 360°.

2. The extensible light fixture as claimed in claim 1 wherein said first and second arm means are tubular members and said first swivel joint is formed with a central bore, a power cord connected to said socket means is threaded through said first and second arm means and said swivel joint bore, said base formed with a hole through which said power cord passes.

3. The extensible light fixture as claimed in claim 1 wherein each of said rotatable members is formed with a central bore, said central bores being coaxial about said rotational axis, each said bore having an enlarged portion and a narrowed portion, each said shoulder between said enlarged portion and said narrowed portion, said narrowed portions adjacent one another, said pin received within said narrowed portions and pressed against said shoulders for holding said rotatable members in axial alignment.

4. The extensible light fixture as claimed in claim 3 wherein said first slidable member is a first ball, said first and second races each having an approximate length of the sum of pi multipled by the radius of said first race and the diameter of said first ball.

5. The extensible light fixture as claimed in claim 4 including a second swivel joint connected between said socket means and said one end of said second arm means, said second swivel joint having a pair of cooperating rotatable sections that are juxtaposed in mating relationship, each said section having an internal shoulder, a second pin engaging each said internal shoulder of each said section, said sections constrained for free rotational movement and fixed against vertical separation relative to one another by said second pin, one of said sections operatively connected to said socket means and the other of said sections connected to said one end of said second arm means, one face of said one section adjacent one face of said other section, said one face of said one section formed with a third race and said one face of said other section formed with a fourth race, and third and fourth races disposed in congruent arcuate paths that are coaxial with a rotational axis of said second swivel joint, portions of said third race aligned with portions of said fourth race, a second channel formed between said aligned portions of said third and fourth races, a second slidable member received in said second channel, each of said third and fourth races having an approximate length of the sum of pi multiplied by a radius of said third race and the arcuate length of said second slidable member, the relative rotation of said one section and said other section limited to one complete revolution.

6. An extensible light fixture that is mountable to a vertical wall, said light fixture comprising:

(a) a base configured to be mounted to said vertical wall;

(b) socket means configured to receive a lamp;

(c) first and second arms interconnecting said base and said socket means;

(d) first rotatable swivel joint means having first and second cooperating members that are juxtaposed in mating relationship and constrained for relative rotation with respect to one another of a maximum of 360°, said first cooperating member connected to said base, said second cooperating member connected to one end of said first arm; and (e) second rotatable swivel joint means having third and fourth cooperating members that are juxtaposed in mating relationship and are constrained for relative rotation with respect to one another of a maximum of 360°, said third cooperating member connected to the other end of said first arm, said fourth cooperating member connected to one end of said second arm, said socket means operatively connected to the other end of said second arm, said first arm and said second arm constrained by said first and said second swivel joint means for movement into a first plane that is in spaced parallel relationship to a second plane in which said base is disposed when mounted to said vertical wall,

7. The light fixture as claimed in claim 6 wherein said first and second cooperating members are juxtaposed in mating relationship, one face of said first member adjacent one face of said second member, a first arcuate race formed in one said face of said first member and a second arcuate race formed in said one face of said second member, said first and second races of substantially equal length and disposed in congruent paths that are coaxial with a rotational axis of said first swivel joint, portions of said first race aligned with portions of said second race, a first channel formed between said aligned portions of said first and second races, a first movable stop received within said first channel for limiting said relative rotation of said first and second members to one complete revolution, said first race and said second race each having an approximate length of the sum of pi multiplied by a radius of said first race and the length of said first movable stop disposed along the arcuate path of said first race, said first movable stop moved a maximum distance of 180° as said first and second members are relatively rotated 360°.

8. The light fixture as claimed in claim 7 wherein said third and fourth cooperating members are juxtaposed in mating relationship, one face of said third member adjacent one face of said fourth member, a third arcuate race formed in said one face of said third member and a fourth arcuate race formed in said one face of said fourth member, said third and fourth races of substantially equal length and disposed in congruent paths that are coaxial with a rotational axis of said second swivel joint, portions of said third race aligned with portions of said fourth race, a second channel formed between said aligned portions of said third and fourth races, a second movable stop received within said second channel for limiting said relative rotation of said third and fourth members to one complete revolution, said third race and said fourth race each having an approximate length of the sum of pi multiplied by a radius of said third race and the length of said second movable stop disposed along the arcuate path of said third race, said second movable stop moved a maximum distance of 180° as said third and fourth members are relatively rotated 360°, said first arm movable in a third plane and said second arm movable in a fourth plane, said third plane parallel to said fourth plane, said first and second planes perpendicular to said third and fourth planes.

9. The light fixture as claimed in claim 8 wherein a central bore is formed in each of said first, second, third and fourth cooperating members, said central bores of said first and second cooperating members being coaxial, said central bores of said third and fourth cooperating members being coaxial, each said central bore having an enlarged portion and a narrowed portion, a shoulder formed between each said enlarged portion and each said narrowed portion, a first pin having an enlarged head at one end received within said enlarged portion of said first member bore and second member bore, said enlarged head of said first pin nesting against said shoulder of said first member bore, said other end of said first pin flared against said shoulder of said second member bore, said first member and said second member constrained for free rotational movement and fixed against vertical separation relative to one another by said first pin, a second pin having an enlarged head at one end received within said enlarged portion of said third member bore and said fourth member bore, said enlarged head of said second pin nesting against said shoulder of said third member bore, said other end of said second pin flared against said shoulder of said fourth member bore, said third member and said fourth member constrained for free rotational movement and fixed against vertical separation relative to one another, and wherein said first and second arms are tubular members, a power cord threaded successively through said central bores of said first and second cooperating members, said first arm, said central bores of said third and fourth cooperating members and said second arm, said power cord connected to said socket means.

10. The light fixture as claimed in claim 9 including:

(a) third rotatable swivel joint means connected between said other end of said second arm and said socket means; and (b) a shade mounted to said third swivel joint means, said shade being an elongated channel member having a generally U-shaped profile in right cross section with closed ends, said socket means disposed within said shade, said shade movable in a fifth plane about an axis of said third swivel joint means, said third plane parallel to said fifth plane, said light fixture movable between a retracted position and an extended position, rotational axes of said first and third swivel joint means in axial alignment and a longitudinal axis of said shade in said first plane when said light fixture is in said retracted position.

* * * * *